US006299079B1

(12) United States Patent
Noller et al.

(10) Patent No.: US 6,299,079 B1
(45) Date of Patent: Oct. 9, 2001

(54) FUEL INJECTOR

(75) Inventors: Klaus Noller, Oppenweiler; Werner Hanft, Hallstadt; Dieter Maier, Gerlingen; Hubert Stier, Asperg; Hans Weidler, Pettstadt; Guenter Dantes, Eberdingen; Detlef Nowak, Untergruppenbach; Werner Schneider, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/485,967

(22) PCT Filed: May 18, 1999

(86) PCT No.: PCT/DE99/01476

§ 371 Date: May 12, 2000

§ 102(e) Date: May 12, 2000

(87) PCT Pub. No.: WO99/66196

PCT Pub. Date: Dec. 23, 1999

(30) Foreign Application Priority Data

Jun. 18, 1998 (DE) ..... 198 27 137
Nov. 18, 1998 (DE) ..... 198 53 102

(51) Int. Cl.[7] ..... B05B 1/00
(52) U.S. Cl. ..... 239/600; 123/472; 251/129.15
(58) Field of Search ..... 123/472, 470; 239/600, 585.1; 251/129.21, 129.15, 129.16

(56) References Cited

U.S. PATENT DOCUMENTS 4,610,080 9/1986 Hensley .
4,722,364 * 2/1988 Kubach et al. ..... 137/625.65
5,156,124 10/1992 Sugimoto et al. .
5,165,656 * 11/1992 Maier et al. ..... 251/129.21
5,294,904 * 3/1994 Volz ..... 335/299
5,427,319 * 6/1995 Bata ..... 239/585.4
5,428,883 * 7/1995 Stieglitz ..... 29/602.1
5,540,387 * 7/1996 Reiter et al. ..... 239/408
5,769,391 * 6/1998 Noller et al. ..... 251/129.21
5,820,031 * 10/1998 Reiter et al. ..... 239/585.1
5,996,227 * 12/1999 Reiter et al. ..... 29/888.45
6,003,791 * 12/1999 Reiter ..... 239/575
6,131,829 * 10/2000 Ricco ..... 239/585.1
6,142,395 * 11/2000 Reiter ..... 239/585.1
6,182,912 * 2/2001 Muller et al. ..... 239/585.1

FOREIGN PATENT DOCUMENTS 34 39 672 A1 4/1986 (DE) .
38 34 444 A 4/1990 (DE) .
197 12 591 A 10/1998 (DE) .
WO 95 33134 A 12/1995 (WO) .

* cited by examiner

*Primary Examiner*—Carl S. Miller
(74) *Attorney, Agent, or Firm*—Kenyon & Kenyon

(57) ABSTRACT

A fuel injector for fuel-injection systems of internal combustion engines includes two preassembled, independent assemblies. A functional part includes an electromagnetic circuit and a sealing valve, while a connection part is formed mainly by a hydraulic connection and an electrical connection. In the ready-mounted injector, electrical connecting elements and hydraulic connecting elements of both assemblies cooperate, thus ensuring a reliable electrical and hydraulic connection An extrusion coat in the interconnection region provides mechanical joining of both assemblies, great stability of the valve and sufficient imperviousness.

16 Claims, 5 Drawing Sheets

FUEL INJECTOR

FIELD OF THE INVENTION

The present invention relates to a fuel injector for fuel injection systems of internal combustion engines.

BACKGROUND INFORMATION

A fuel injector that may be actuated electromagnetically is discussed, for example, in U.S. Pat. No. No. 5,156,124. The fuel injector includes an electromagnetic circuit, such as a magnetic coil, an internal pole and an external pole. This injector is a "side-feed injector" in which the fuel is supplied substantially below the magnetic circuit. Starting from the magnetic coil, contact pins project from the fuel injector, are extrusion-coated over a certain length with plastic and are embedded in the plastic. The plastic extrusion coat is applied at one end of the fuel injector, and does not represent an independent component of the injector.

German Published Patent Application No. 34 39 672 concerns a fuel injector, in which, starting from its magnetic coil, contact pins project to an electric attachment, plug which is formed of plastic and partially surrounds the contact pins behind the magnetic coil. In this case, the plastic extrusion coat forming the attachment plug is sprayed onto the metallic valve housing.

German Published Patent Application No. 197 12 591 concerns a fuel injector that may be assembled from two preassembled assemblies, which include a functional part and a connection part, that are separately produced, brought into position and then permanently joined to one another. The joining of the two assemblies also produces an electrical and a hydraulic connection. The two assemblies are joined by ultrasonic welding, bonding or crimping.

SUMMARY OF THE INVENTION

It is believed that the fuel injector of an exemplary embodiment of the present invention has and reliably mounted. It is believed that this should provide relatively great mechanical stability of the fuel injector. In addition, it is believed that this should better ensure that the electrical connecting elements are safe and protected within the valve.

In addition, it is possible to vary the designs of the fuel injector very easily. This is achieved in that two assemblies of the fuel injector—a functional part and a connection part—are preassembled and brought into position separately from one another. The functional part essentially includes an electromagnetic circuit and a sealing valve composed of a valve-seat member and valve-closure member. On the other hand, the electrical and the hydraulic connections of the injection valve are provided in the connection part. All the described exemplary embodiments of the fuel injectors have the advantage that they can be produced cost-effectively with a great number of design variants. Functional parts, produced in large quantity with a substantially identical design (differences, for example, in the size of the valve-needle lift or the number of turns of the magnetic coil) can be joined to a very large number of different connection parts which differ, for example, in size and shaping, in the design of the electrical attachment plug, in the formation of the lower end face of the connection part, or even with respect to their color, marking, inscription or a different identification. Thus, in general, the logistics are simplified when producing fuel injectors.

The separation into two assemblies yields the advantage that all the negative influences when producing the connection part, made substantially of plastic, (high extrusion-coating pressures, heat generation) are kept away from the components of the functional part performing the important valve functions. The relatively dirty extrusion-coating process can advantageously be carried out outside of the functional-part assembly line.

For the extrusion coating to produce a firm joining of the two assemblies. It is believed that it is particularly advantageous to select a plastic which has its melting point at a higher temperature than the plastic used for the connection part. This ensures that the two plastics enter into polymer combination. It is believed that it is advantageous to design a labyrinth seal at the outer periphery of the connection part. This permits heat distribution during the extrusion coating, allowing good fusing. In addition, high mechanical stability in this region, and thus of the entire fuel injector, as well as good imperviousness are ensured.

It is believed that it is advantageous to provide the functional part, performing all the important valve functions, with a very short design. This expediently yields simplified access to the injector components to be adjusted, including shortened paths for the mounting of measuring arrangements such as probes for measuring the lift of the valve needle or tools for adjusting the dynamic spray quantity at the adjustment element.

Advantageously, provision can be made on the connection part at its downstream end for a plurality of axially projecting segments which extend into the extrusion coat after the extrusion-coating process. The dissipation of heat during the extrusion-coating process is improved by these segments projecting into the extrusion coat. At the same time, the hot volume in the extrusion-coating process is kept quite small. In this manner the cycle time of the extrusion coating can be markedly reduced. Moreover, the mass agglomeration within the extrusion coat is advantageously reduced. The shrinkage cavitation can thus be effectively diminished. In addition, due to the segments, turbulence develops in the flowing plastic. This results in increased stability of the entire extrusion coat.

It is expedient to arrange a fuel filter in the functional part. A possibility is to use a metal filtration fabric as a screen netting. This guarantees that, until the final assembly of the valve, no dirt particles can get into the interior of the functional part.

Advantageously, the electrical connecting elements on the functional part and connection part can be varied greatly. Thus, it is possible at anytime to design the electrical connecting elements both on the functional part and on the connection part either in a manner similar to a plug or in a manner similar to a socket, or as a combination of both possibilities.

DETAILED DESCRIPTION

Figure 1:
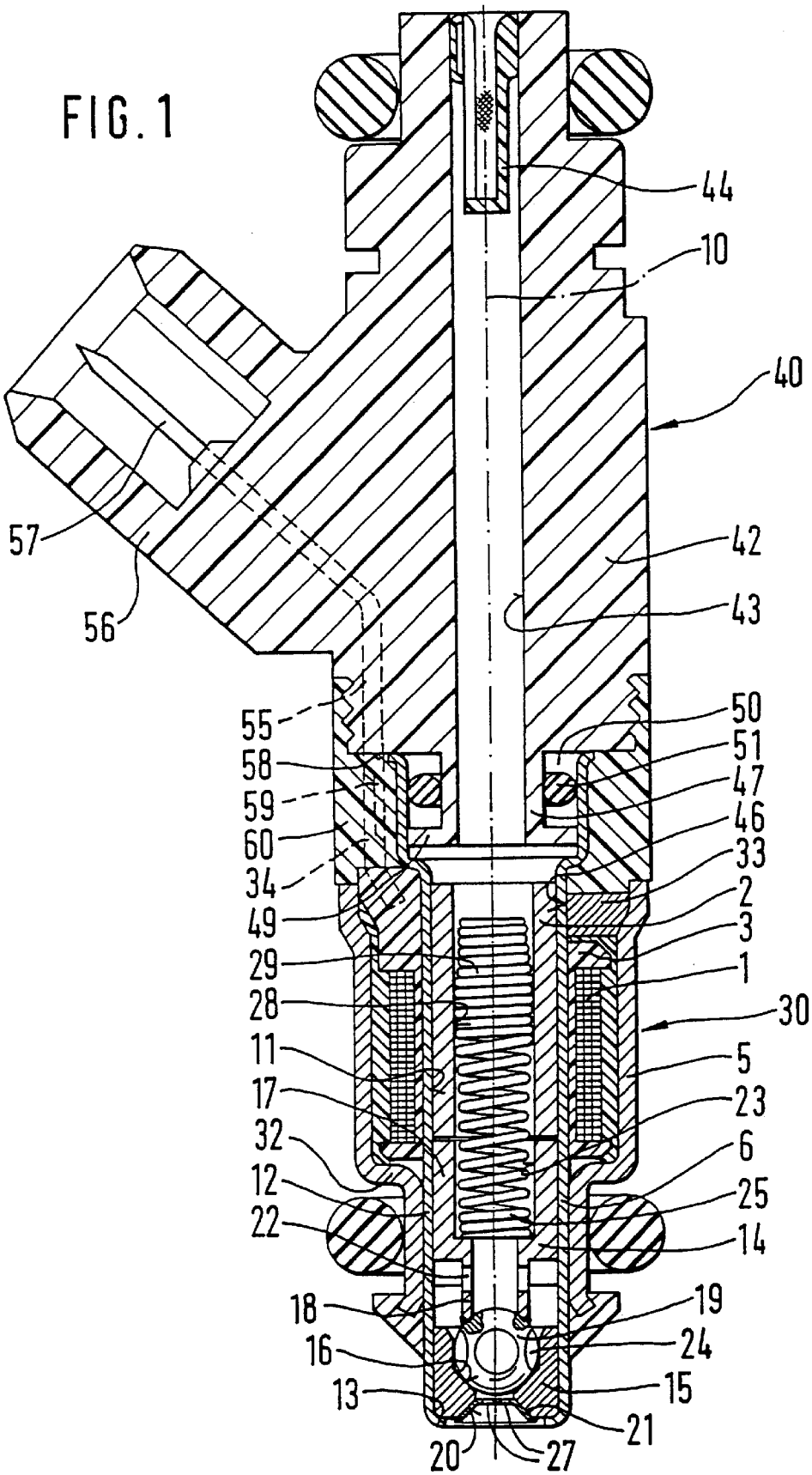
FIG. 1 shows a first fuel injector, according to an exemplary embodiment of the present invention, that has two independently preassembled assemblies in the assembled state.

FIG. 1 shows an electromagnetically operable valve of an exemplary embodiment of the present invention that is an injector for fuel-injection systems of mixture-compressing internal combustion engines with externally supplied ignition, has a substantially tubular core 2 that is surrounded by a magnetic coil 1 and is used as an internal pole and partially as a fuel passage. Magnetic coil 1 is surrounded by an outer, sleeve-shaped, stepped, valve jacket 5 (which, for example, may be a ferromagnetic valve jacket) as external pole which completely surrounds magnetic coil 1 in the circumferential direction. Magnetic coil 1, internal pole 2, and external pole 5 together form an electrically excitable actuating element. As a further exemplary embodiment variant (not shown), the actuating element can be completely designed as a piezoelectric actuator, as well.

While magnetic coil 1, which is embedded in a coil shell 3, surrounds a valve sleeve 6 from the outside, core 2 is mounted in an inner opening 11 of valve sleeve 6, opening 11 running concentrically to a longitudinal valve axis 10. The valve sleeve 6 (which, for example, may be ferritic) is elongated. and thin-walled and has a jacket section 12 and a bottom section 13, with the opening 11 being bounded at its downstream end in the circumferential direction by jacket section 12 and in the axial direction by bottom section 13. Opening 11 is also used as a guide opening for a valve needle 14 that is axially moveable along longitudinal valve axis 10.

Besides core 2 and valve needle 14, also arranged in opening 11 is a valve-seat member 15 which, for example, is mounted on bottom section 13 of valve sleeve 6 and has a fixed valve-seat surface 16 as valve seat. Valve needle 14 is formed, for example, by a tubular armature section 17, a likewise tubular needle section 18 and a spherical valve-closure member 19, valve-closure member 19 being firmly joined to needle section 18 by, for example a weld seam. At the downstream end face of valve-seat member 15, a flat spray-orifice plate 21 is arranged, for example in a frusto-conical depression 20, valve-seat member 15 and spray-orifice plate 21 being firmly joined, for example by a continuous impervious weld seam. In needle section 18 of valve needle 14, one or more transverse openings 22 are provided, so that fuel flowing through armature section 17 in an inner longitudinal bore hole 23 can emerge outwardly and flow along valve-closure member 19, such as, for example along flattenings 24, up to valve-seat surface 16.

The injector is actuated in known manner; here, for example, electromagnetically. However, a piezoelectric actuator may also be used to the extent appropriate. The electromagnetic circuit including magnetic coil 1, inner core 2, outer valve jacket 5 and armature section 17, is used to axially move valve needle 14, and thus to open the injector against the spring tension of a return spring 25 acting upon valve needle 14, and to close the injector. The end of armature section 17 facing away from valve-closure member 19 is aligned toward core 2.

Spherical valve-closure member 19 cooperates with valve-seat surface 16 of valve-seat member 15, valve-seat surface 16 being formed in valve-seat member 15 in the axial direction downstream of a guide opening and tapering frustoconically in the direction of flow. Spray-orifice plate 21 has at least one, and for example, at least up to four spray orifices 27 formed by eroding, laser boring or punching.

The insertion depth of core 2 in the injector is believed to affect, for the lift of valve needle 14. In this context, the one end position of valve needle 14, when magnetic coil 1 is not excited, is determined by the contact of valve-closure member 19 against valve-seat surface 16 of valve-seat member 15, whereas the other end position of valve needle 14, when magnetic coil 1 is excited, is determined by the contact of armature section 17 against the downstream core end. The lift is adjusted by axially displacing core 2, which is subsequently fixedly joined to valve sleeve 6 according to the desired position.

In addition to return spring 25, an adjusting element in the form of an adjusting (or equalizer) spring 29 is inserted into a flow hole 28 of core 2, with the flow hole 28 running concentrically to longitudinal valve axis 10 and being used for supplying fuel in the direction of valve-seat surface 16. Adjusting spring 29 is used for adjusting the resilience of return spring 25 which abuts against adjusting spring 29 and is in turn supported with its opposite side against valve needle 14, with the dynamic spray quantity also being adjusted by adjusting spring 29. Instead of an adjusting spring, the adjusting element can also be an adjusting bolt, adjusting sleeve, etc.

The injector described up to this point has the distinction of a particularly compact design, resulting in a very small, manageable injector. These components form a preassembled, independent assembly which, in the following, is referred to as functional part 30, and is shown separately again in FIG. 3 as such an assembly. Thus, functional part 30 essentially includes electromagnetic circuit 1,2,5, as well as a sealing valve (valve-closure member 19, valve-seat member 15) having a subsequent jet preparation element (spray-orifice plate 21).

The coil space, which is formed between valve jacket 5 and valve sleeve 6 and is almost completely filled by magnetic coil 1, is delimited in the direction facing valve-seat member 15 by a stepped radial region 32 of valve jacket 5, while the closure on the side facing away from valve-seat member 15 is assured by a disk-shaped cover element 33. Coil shell 3 protrudes through an opening in cover element 33. In this region, for example, two contact pins or female contacts 34 project from the plastic of coil shell 3, and thus from functional part 30. The electrical contacting of magnetic coil 1, and thus its excitation, is effected via electrical contact pins or female contacts 34 which are used as electrical connecting elements.

A second assembly, referred to in the following as connection part 40, is produced completely independently of functional part 30. Independent and preassembled connection part 40 is shown in FIG. 1 assembled with functional part 30 as part of the entire injector, and is shown separately and independently in FIG. 2. Connection part 40 includes the electrical and hydraulic connections of the fuel injector. Therefore, connection part 40, which is constructed largely as a plastic part, has a tubular base member 42 used as a fuel-intake nipple.

For example, a fuel filter 44 is inserted or pressed into a flow hole 43 of base member 42, with the flow hole 43 running concentrically to longitudinal valve axis 10, and fuel flowing through it from the inflow end of the fuel injector in the axial direction. Fuel filter 44 projects into flow hole 43 of base member 42 at its inflow-side end and filters out such fuel constituents which, because of their size, could cause blockage or damage in the injector.

When the fuel injector is fully assembled, connection part 40 and functional part 30 are hydraulically connected by bringing flow holes 43 and 28 of both assemblies together in such a way as to ensure an unhindered flow of fuel. An inner opening 46 in cover element 33 makes it possible to construct valve sleeve 6, and thus also core 2, in such a way that both protrude through opening 46, and at least valve sleeve 6 projects markedly beyond cover element 33 in the direction toward connection part 40. When mounting connection part 40 on functional part 30, a lower end region 47 of base member 42 can protrude into the projecting part of valve sleeve 6 into opening 11 of valve sleeve 6 to increase the connection stability.

For example, end region 47 of connection part 40 has a stepped design, with the base member 42 tapering off sharply at a lower end face 58 from the outside diameter. End face 58, together with a lower annular collar 49, delimits an annular groove 50 in which a sealing element such as an O-shaped sealing ring 51 is arranged. Thus, sufficient sealing is ensured in the interconnecting region of both assemblies 30 and 40.

In addition, provision is made in connection part 40 for two electrical contact elements 55 which are extrusion-coated during the plastic injection molding process of base member 42, and subsequently exist embedded in the plastic. Also belonging to plastic base member 42, which is used largely as a fuel- intake nipple, is a simultaneously injection-molded electric attachment plug 56. At their one end, electrical contact elements 55 terminate as exposed contact pins 57 of electric attachment plug 56 that can be connected to a corresponding electrical connector element, not shown, such as a terminal strip for complete electrical contacting of the injector. At their end opposite attachment plug 56, contact elements 55 run to lower end face 58 of connection part 40, and there form an electrical connecting element 59 designed, for example, as contact pins which are likewise exposed. When the fuel injector is completely assembled, electrical connecting elements 34 and 59 cooperate in such a way that a reliable electrical connection is formed, contact pins 59 engaging, for example. with socket-like, eye-like, clamp-like, pin-shaped or cable-lug-shaped connecting elements 34 on functional part 30. Examples for this are shown in FIGS. 5, 6A to 6C, and 7A to 7D. Thus, the electrical contacting of magnetic coil 1, and therefore its excitation, is effected via electric attachment plug 56 and via electrical interconnection regions 34, 59.

Figure 3:
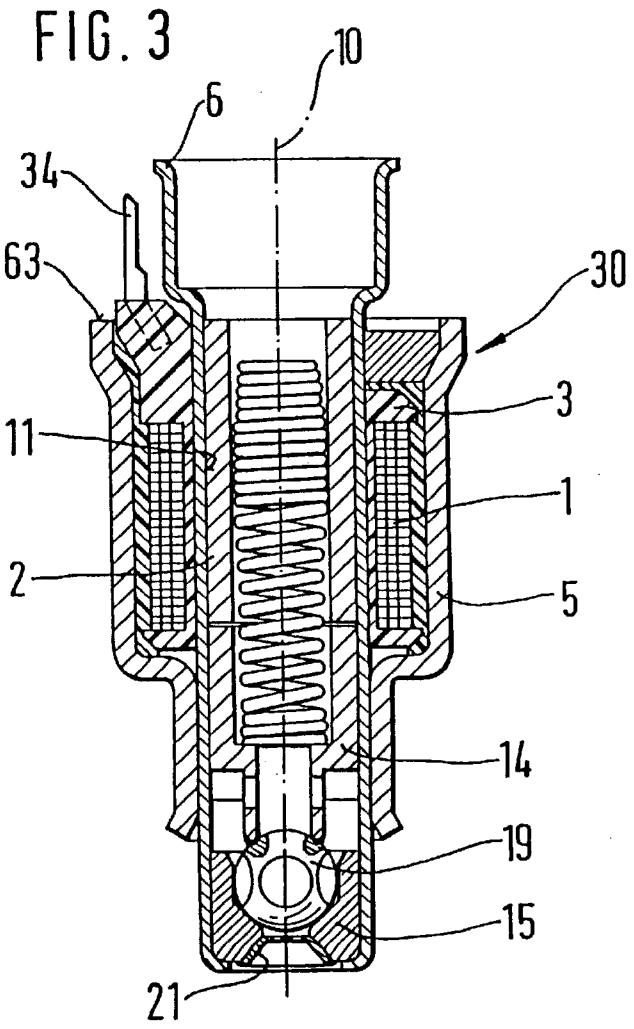
FIG. 3 shows a functional part of the valve, according to FIG. 1, that represents the second assembly.
Figure 2:
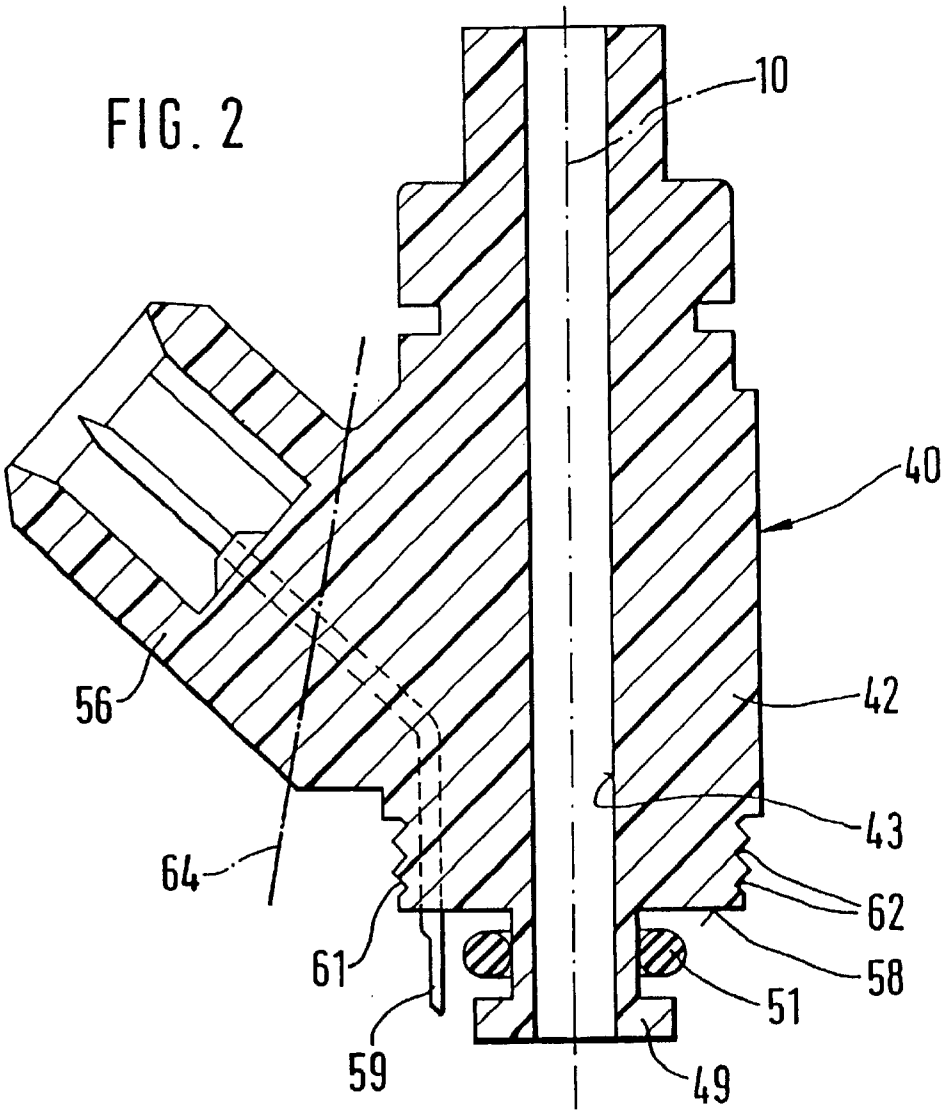
FIG. 2 shows a connection part of the valve, according to FIG. 1, that represents the first assembly.

FIGS. 2 and 3 show the two independent and already preassembled assemblies—functional part 30 and connection part 40—prior to the final assembly of the fuel injector. It should be expressly emphasized that both functional part 30 and connection part 40, each taken for itself, can have a modular construction, which is intended to mean that certain subassemblies can be used to simplify the production and mounting of assemblies 30 and 40. One example each for assemblies 30 and 40 is given for such a further modular subdivision. which, however, are not shown in more detail in the Figures.

In FIG. 2, a possible module separating line 64 is indicated by a dot-dash line, which is intended to show that attachment plug 56 can also be variably shaped in order to then be used on various base members 42. Thus, in such a design, assembled the hydraulic connection (base member 42 with flow hole 43) and the electrical connection (attachment plug 56 with contact pins 57) exist separately from each other. Only in the assembled state do the two subassemblies yield the described connection part 40. Electrical connecting elements corresponding to one another, which can be designed like electrical connecting elements 34 and 59, are provided in the interconnection region for the reliable electrical connection of the two subassemblies. The subassemblies are permanently joined by welding, soldering, bonding or an extrusion coat.

Furthermore, functional part 30 can also be composed of modular subassemblies in so far as, for example, the jet-spray preparation element in the form of spray-orifice plate 21 is built into a spray assembly which, for the moment, is separate, and is only subsequently integrated on functional part 30. In this context, the possibility offers itself of using, for example, multilayer orifice plates, which may be produced by "multilayer electroplating", in the spray assembly which can be a disk-shaped orifice-plate carrier. The orifice plates can have opening contours capable of producing very different spray patterns, or of applying a twist to the spray. The spray assembly, which may have various designs, can be secured by welding, such as, for example, laser welding, downstream of valve seat 16 to valve-seat member 15 or a housing part of functional part 30. The spray assembly with spray-orifice plate 21 can be provided, for example, inclined at an angle with respect to the longitudinal axis, as a subassembly on functional part 30.

After the appropriate pre-assembly, the two assemblies—functional part 30 and connection part 40—are fixedly joined to one another in a last method step. To that end, connection part 40 is introduced so far into opening 11 of valve sleeve 6 in functional part 30, until end face 58 comes to strike, for example, against valve sleeve 6, whereby the hydraulic connection of both assemblies 30, 40 is already realized with the appropriate sealing by sealing ring 51 at valve sleeve 6. At the same time, the electrical connection of both assemblies 30, 40 is also produced, since the electrical connecting elements 34 and 59 of both sides intermesh (FIG. 1).

An exemplary embodiment of the invention, preassembled assemblies 30, 40 are extrusion-coated in the interconnection region to mechanically join both assemblies 30, 40. In so doing, annularly at the outer periphery of valve sleeve 6, the volume between lower end face 58 of connection part 40 and cover element 33 of functional part 30 is filled with plastic up to the outer periphery of base member 42 and of valve jacket 5, respectively, so that a flush seal is formed toward the outside (see FIG. 1). This extrusion coat 60 safely protects electrical connecting elements 34, 59 from the influences of the engine compartment (such as, for example, dirt and fuel).

For extrusion coat 60, shaped as a "belly band", a plastic is selected which has its melting point at a higher temperature than the plastic used for connection part 40, so that the two plastics enter into polymer combination. Above end face 58, the outer periphery of base member 42 is designed as a labyrinth seal 61, in which a plurality of grooves or furrows 62 extend annularly at the periphery of base member 42. The material between the individual furrows 62 should taper somewhat to a point radially to the outside, so that during the extrusion coating, good heat distribution is produced in this interconnection region, thereby permitting good fusing. In addition, the greater surface area attained by furrows 62 assure that a very reliable bonding of the two plastics is achieved, thus guaranteeing high mechanical stability in this region, and thus of the entire fuel injector, in addition to good seal tightness.

On the other hand, the quality of the joining between plastic extrusion coat 60 and metal functional part 30 is improved, for example, by recessing or crimping a plurality of grooves at upper end 63 of valve jacket 5 facing connection part 40.

Figure 4:
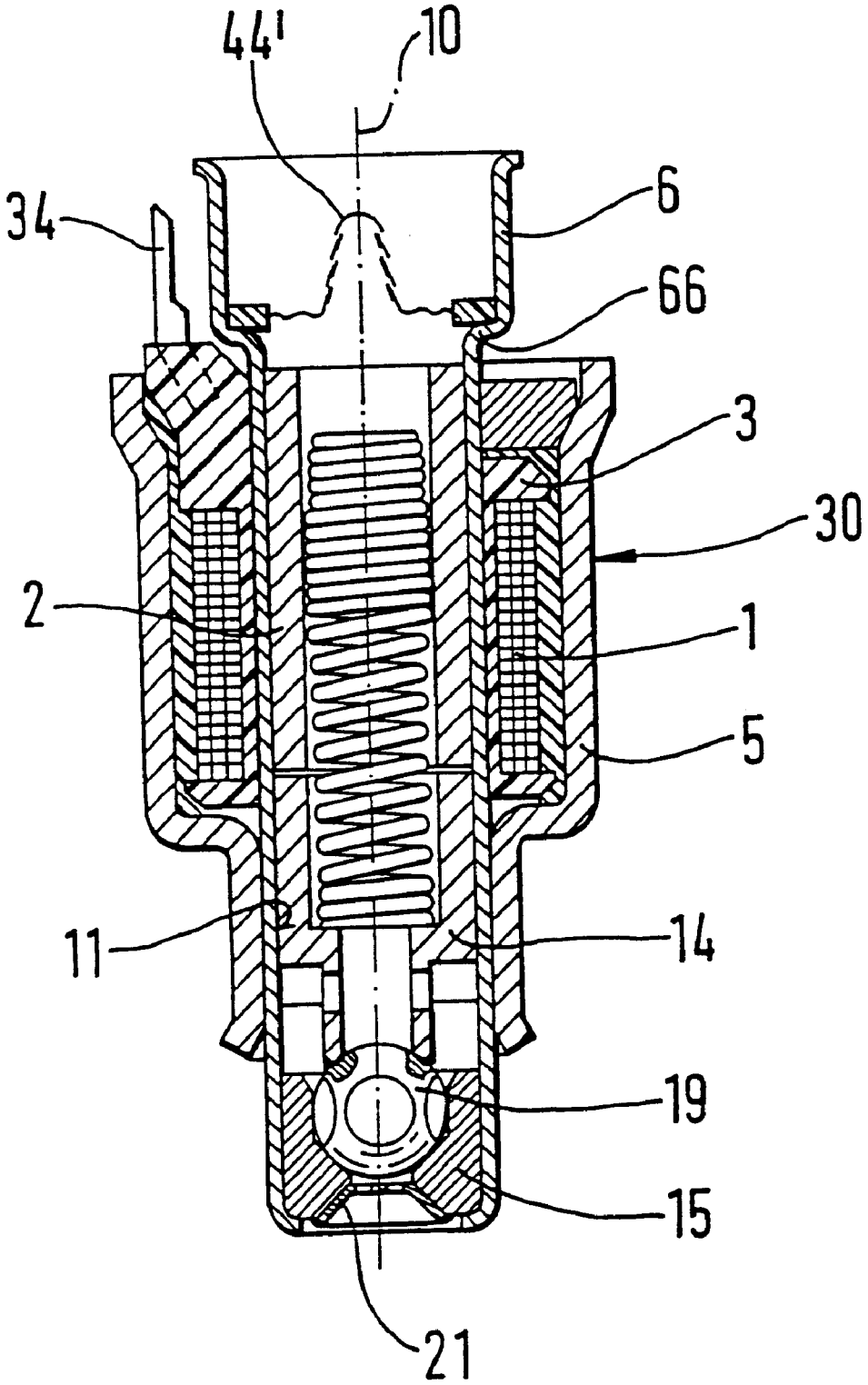
FIG. 4 shows a second exemplary embodiment of a functional part.

FIG. 4 shows a second exemplary embodiment of a functional part 30. The components which are uniform or exercise essentially similar effects compared to the exemplary of FIG. 4 that correspond to the components of the exemplary.

In FIG. 4, a fuel filter 44' is arranged on functional part 30, and specifically, either in addition to fuel filter 44 already mounted on connection part 40, or advantageously, in place of fuel filter 44 on connection part 40. For example, fuel filter 44' is braced against a gradation 66 of valve sleeve 6 above core 2. The relatively large diameter of opening 11 of valve sleeve 6 in the region of gradation 66 allows the use of a flat filter instead of a basket filter (shown in FIG. 1). In this context, the screen netting can also be arched, as can be seen in FIG. 4. It is possible to use a metal filtration fabric as a screen netting which, with a screen aperture of 30 $\mu$m, possesses a sufficient free filtering surface. Thus, it is guaranteed that when handling preassembled functional part 30 up to the final assembly with connection part 40, no dirt particles get into the interior of functional part 30.

Figure 5:
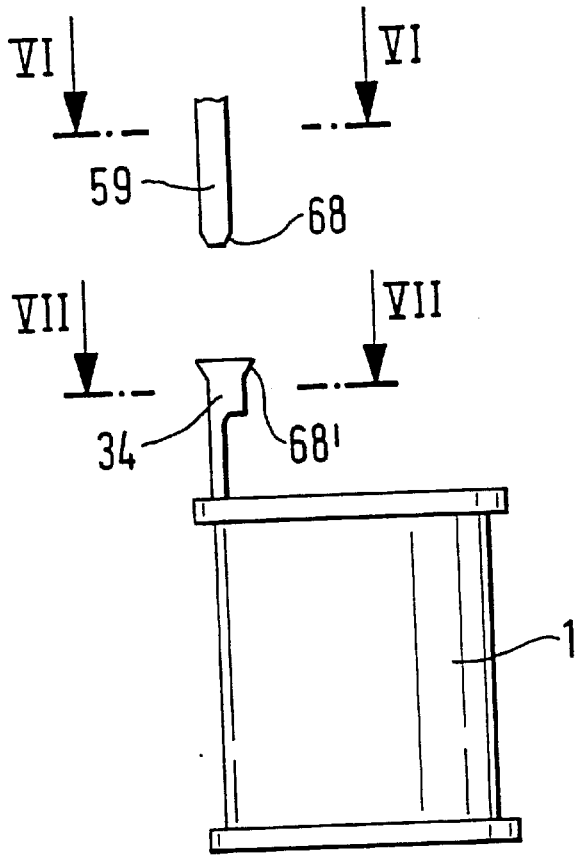
FIG. 5 shows an electrical interconnection region in a schematic representation.
Figure 6A:
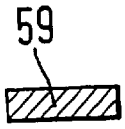
FIG. 6A shows a first exemplary embodiment for contact pins corresponding to a section along the line VI—VI in FIG. 5.
Figure 6B:
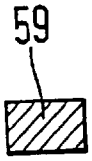
FIG. 6B shows a second exemplary embodiment for contact pins corresponding to a section along the line VI—VI in FIG. 5.
Figure 6C:
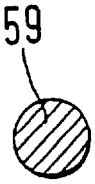
FIG. 6C shows a third exemplary embodiment for contact pins corresponding to a section along the line VI—VI in FIG. 5.

Various possibilities for producing the electrical connection between the two components parts 30, 40 are shown in FIGS. 5 through 7. FIG. 5 shows the electrical interconnection region with electrical connecting elements 34, 59 in schematic representation, while FIGS. 6A through 6C show three specific embodiments for contact pins 59 of connection part 40 corresponding to a section along the line VI—VI in FIG. 5, and FIGS. 7A through 7D show four specific embodiments for female (or insert) contacts 34 of functional part 30 corresponding to a section along the line VII—VII in FIG. 5.

Thus, according to FIGS. 5 and 6, electrical connecting elements 59 of connection part 40 are designed to be pin-shaped as contact pins 59. At their ends, contact pins 59 have, for example, entry slants 68 which facilitate the production of the electrical connection with corresponding connecting elements 34 of functional part 30. As FIGS. 6A through 6C show, the cross-sections of contact pins 59 can be, for example, rectangular (FIG. 6A), substantially square (FIG. 6B) or circular (FIG. 6C).

Figure 7A:
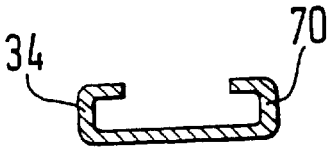
FIG. 7A shows a first exemplary embodiment for female contacts corresponding to a section along the line VII—VII in FIG. 5.
Figure 7B:
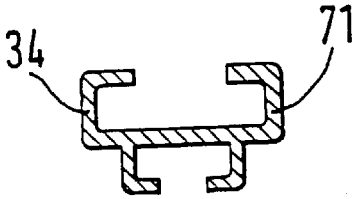
FIG. 7B shows a second exemplary embodiment for female contacts corresponding to a section along the line VII—VII in FIG. 5.
Figure 7C:
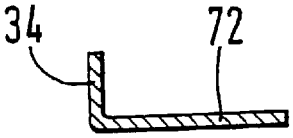
FIG. 7C shows a third exemplary embodiment for female contacts corresponding to a section along the line VII—VII in FIG. 5.
Figure 7D:
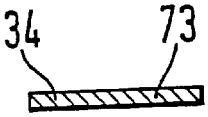
FIG. 7D shows a fourth exemplary embodiment for female contacts corresponding to a section along the line VII—VII in FIG. 5.

Since in the case shown in FIG. 5, connecting element 59 is pin-shaped, it is expedient to make corresponding connecting element 34 socket-shaped in order to implement a safe and reliable electrical connection. In FIG. 7, examples for socket-like, eye-like, clamp-like, cable-lug shaped, but also pin-shaped connecting elements 34 are shown. In this context, the ends of connecting elements 34 facing away from magnetic coil 1 likewise have entry slants 68'. FIG. 7A shows a conventional cable lug 70 which can embrace a contact pin 59 in a clamp-like manner. To accommodate contact pins 59 of different sizes, cable lug 70 can be flexible. FIG. 7B shows a double cable lug 71 that can be used for two different types of contact pins 59. FIGS. 7C and 7D show two variants of a profile connecting element 34, with the profile element 34 according to FIG. 7C being designed as an L-profile pin 72, and connecting element 34 according to FIG. 7D being designed as a flat profile pin 73. The two last-named variants do not surround contact pins 59 to be contacted, but rather contact is made by abutting tightly. After producing the electrical connection, the fixation can also be supported by an additional weld point before extrusion coat 60 is applied.

However, it is also of course possible to provide electrical connecting elements 34 on functional part 30 in pin form, while electrical connecting elements 59 of connection part 40 would then more likely be socket-like, eye-like or cable-lug shaped. Another possibility is in each case to construct one plug-like and socket-like connecting element 34, 59 on functional part 30 and on connection part 40, which can then interact interchangeably with one another. However, an electrical contacting can equally be attained by using, for example, CIN::APSE® technology, in which molybdenum wires coated with gold are formed skein-like as a button contact. This solderless connection technology makes it possible to produce very reliable electrical connections which, mechanically, are completely or at least more resonance-free.

Figure 8:
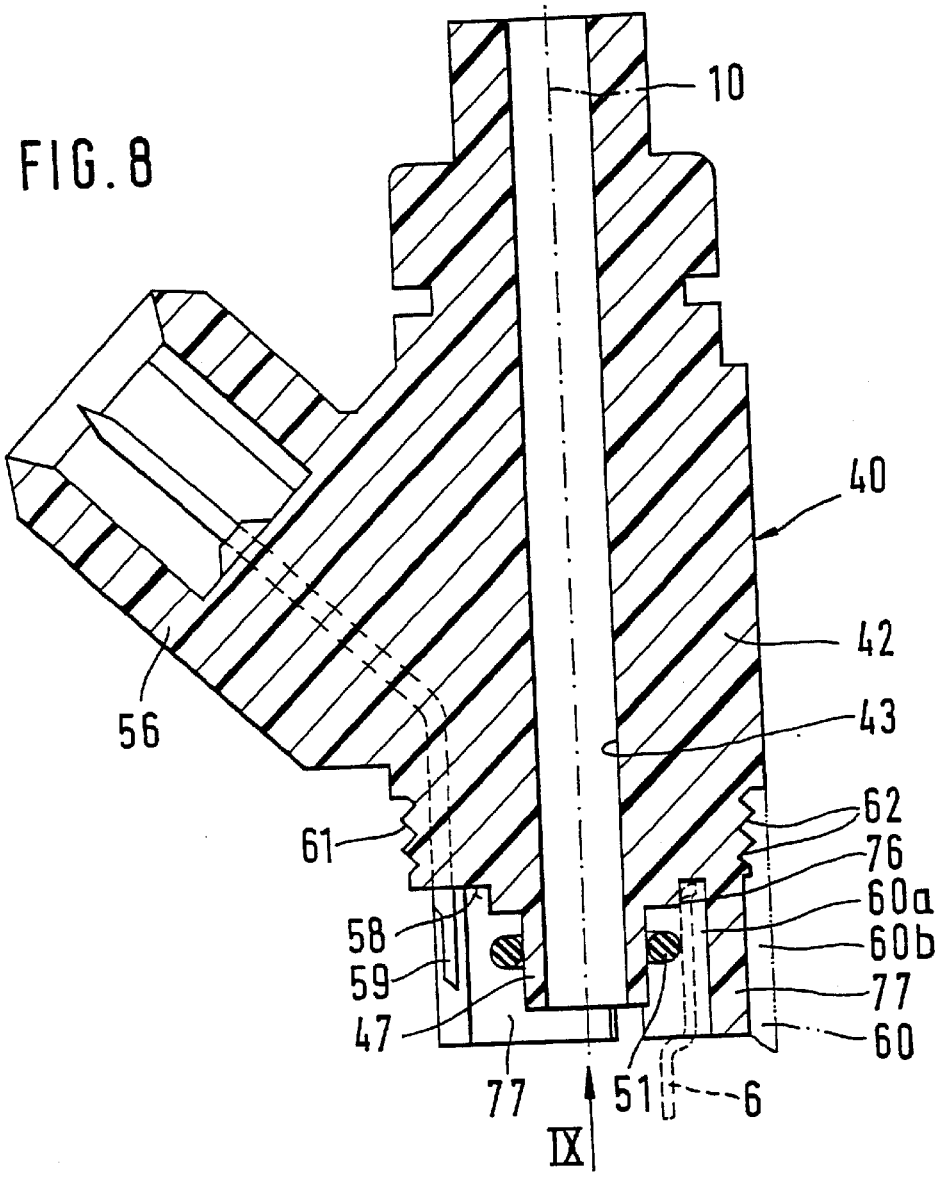
FIG. 8 shows a second exemplary embodiment of a connection part.

FIG. 8 shows a second exemplary embodiment of a connection part 30. The components which are uniform or exercise essentially similar effects compared to the exemplary embodiment shown in FIGS. 1 and 2 are marked by the same reference numerals. In comparison with the exemplary embodiment according to FIG. 2, connection part 40 according to FIG. 8 is designed differently, particularly in the area of end region 47. For example, provision is made at end face 58 for a step 76 which is used as a guide collar for valve sleeve 6 of functional part 30, which is indicated by a dashed line. In the assembled state of the valve, valve sleeve 6 surrounds gradation 76 with an upper sleeve section, for example, in an adjoining manner. In addition, starting from end face 58, at least one segment 77 projects from connection part 40 in the direction toward functional part 30. The at least one segment 77 has a circular shape and, observed in the radial direction, is formed set apart from step 76, however not directly at the outer periphery of connection part 40, at which extrusion coat 60, indicated by a dashed/double-point line, terminates.

Figure 9:
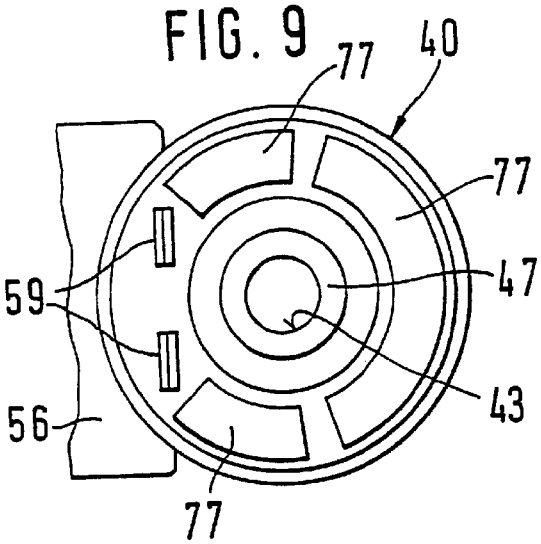
FIG. 9 shows a bottom view of the connection part according to FIG. 8.

FIG. 9 shows a bottom view of connection part 40 according to FIG. 8 in the direction of arrow IX. It can be seen that provision is made on connection part 40 for three segments 77 which, all together, are circular, but which, for example, have different extension lengths in the circumferential direction. This can be necessary on the basis of contact pins 59. Segments 77 have only a small clearance relative to each another. Viewed in the axial direction, segments 77 protrude, for example, just slightly beyond middle end region 47.

Thus, a plurality of segments 77 extend from connection part 40 axially into the space of extrusion coat 60, which is needed for the firm joining of connection part 40 and functional part 30. Due to segments 77, and depending on the particular application, the volume of the extrusion-coat region may be reduced by approximately 30%, and the maximum wall thickness of extrusion coat 60 may be reduced by approximately 50% compared to extrusion coat 60 shown in FIG. 1. FIG. 8 indicates that segments 77 produce an inner extrusion-coat region 60*a* and an outer extrusion-coat region 60*b* which, during the extrusion coating, are filled with plastic with, the two extrusion-coat sections then resulting being interconnected by plastic between and below segments 77. In this manner, after the extrusion coating, segments 77 are embedded in extrusion coat 60. Segments 77 are so arranged that mass agglomerations within extrusion coat 60 are eliminated, and the wall thicknesses turn out uniformly. In addition, it is advantageous to arrange segments 77 in such a way that a strong turbulence of the flowing plastic takes place during the extrusion-coating process.

Figure 10:
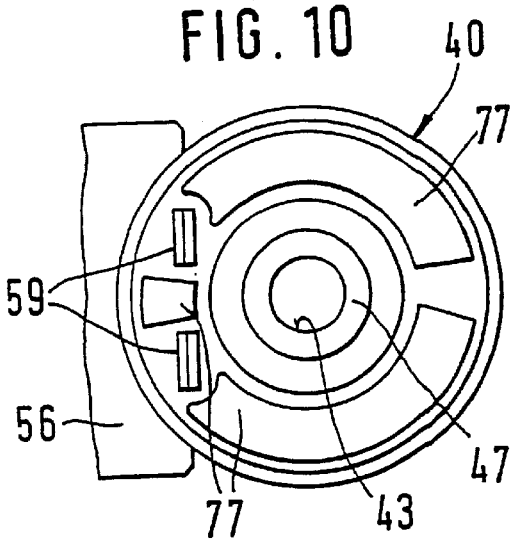
FIG. 10 shows a bottom view of a further connection part.

FIG. 10 shows a bottom view of a further exemplary embodiment of a connection part 40. Here as well, provision is made for three segments 77 extending into the later extrusion coat 60, with a small segment 77 being arranged between the two contact pins 59, and the two other segments 77 each extending in a circular manner over approximately 120°.

It is believed that all the exemplary embodiments of the fuel injector described have the advantage that they can be produced cost-effectively with a great number of design variants. Functional parts 30, which may be produced in large quantity with a substantially identical design, can be joined to a great number of different connection parts 40 which differ, for example, in size, in the form of electrical attachment plug 56, etc. Therefore, the logistics when manufacturing fuel injectors should be simpler.

What is claimed is:

1. A fuel injector for a fuel injection system of an internal combustion engine, comprising:

a preassembled functional part including:
an excitable actuation element,
a sealing valve including a valve-seat member and a moveable valve-closure member,
first electrical connecting elements, and
first hydraulic connecting elements;

a preassembled connection part including:
an electrical connection,
a hydraulic connection,
second electrical connecting elements, and
second hydraulic connecting elements; and a valve seat allocated to the valve-seat member and cooperating with the moveable valve-closure member, wherein the preassembled functional part and the preassembled connection part are independent assemblies that are fixedly joined to one another by an extrusion coat applied in an interconnection region of each of the independent assemblies, and wherein a reliable electrical connection and a reliable hydraulic connection of the independent assemblies are respectively provided by a cooperation of the first electrical connecting elements with the second electrical connecting elements and a cooperation of the first hydraulic connecting elements with the second hydraulic connecting elements.

2. The fuel injector of claim 1, wherein the preassembled connection part is substantially a plastic member that forms a fuel-intake nipple as a base member with a flow aperture passing therethrough, an electrical attachment plug being formed on the base member.

3. The fuel injector of claim 2, wherein the extrusion coat includes another plastic having a higher melting point temperature than that of the plastic member.

4. The fuel injector of claim 2, further comprising:

a labyrinth seal formed at an outer periphery of the base member, the labyrinth seal having one of a plurality of grooves and a plurality of furrows and being covered by the extrusion coat.

5. The fuel injector of claim 1, wherein the preassembled connection part includes at least one segment that protrudes axially in a direction of the preassembled functional part and that is embedded in the extrusion coat after the extrusion coat is applied.

6. The fuel injector of claim 5, wherein the at least one segment is circular.

7. The fuel injector of claim 1, further comprising:

a valve needle;

a core corresponding to an internal pole;

a valve jacket; and a magnetic coil corresponding to an external pole and being at least partially enclosed by the valve jacket, wherein the preassembled functional part includes a thin-walled valve sleeve surrounded by the magnetic coil and including an inner opening in which the valve-seat member, the valve needle, and the core are mounted.

8. The fuel injector of claim 7, wherein the valve jacket includes a plurality of grooves at an end thereof facing the preassembled connection part.

9. The fuel injector of claim 7, wherein the thin-walled valve sleeve encloses an end region of the preassembled connection part extending into the inner opening in the assembled state of the fuel injector.

10. The fuel injector of claim 9, further comprising:

a sealing ring arranged at the end region.

11. The fuel injector of claim 1, further comprising:

a fuel filter integrated in the preassembled functional part.

12. The fuel injector of claim 11, wherein the fuel filter includes a metal filtration fabric as a screen netting.

13. The fuel injector of claim 1, wherein each one of the first electrical connecting elements and the second electrical connecting elements include one of a plug arrangement and a socket arrangement.

14. The fuel injector of claim 13, wherein each one of the first electrical connecting elements includes one of a socket arrangement, an eye arrangement, a clamp arrangement, a cable-lug-shaped arrangement, and a profiled connecting arrangement.

15. The fuel injector of claim 1, wherein at least one of the preassembled connection part and the preassembled functional part includes separately preassembled subassemblies.

16. The fuel injector of claim 2, wherein the electrical attachment plug is connectable to the base member in the interconnection region, the second has electrical connecting elements for producing the reliable electrical connection corresponding to one another.

* * * * *

UNITED STATES PATENT AND TRADEMARK OFFICE

CERTIFICATE OF CORRECTION

PATENT NO. : 6,299,079 B1
DATED : October 9, 2001
INVENTOR(S) : Noller et al.

It is certified that error appears in the above-identified patent and that said Letters Patent is hereby corrected as shown below:

Column 1,
Line 22, change “attachment,” to -- attachment --
Line 39, insert between the words “has” and “and” -- the advantage that it can be produced cost-effectively in a simple manner, and can be safely --

Column 2,
Line 54, change “DRAWING” to -- DRAWINGS --

Column 6,
Line 18, change “design, assembled” to -- design, until assembled, --
Line 60, change “An” to -- According to an --

Column 7,
Lines 27-29, delete “which are uniform or exercise essentially similar effects compared to the exemplary”
Line 30, after “exemplary.” add -- embodiment shown in Figures 1 and 3 are marked by the same reference numerals. --

Column 9,
Line 10, change “with,” to -- with --

Signed and Sealed this

Twentieth Day of May, 2003

JAMES E. ROGAN
*Director of the United States Patent and Trademark Office*